US007182419B2

(12) United States Patent
Salim et al.

(10) Patent No.: US 7,182,419 B2
(45) Date of Patent: Feb. 27, 2007

(54) OUT OF INK SIGNAL MECHANISM FOR AN INKJET PRINTER

(75) Inventors: Senarto Salim, Singapore (SG); Manish Agarwal, Singapore (SG); Chin Tiong Tan, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 238 days.

(21) Appl. No.: 10/769,064

(22) Filed: Jan. 29, 2004

(65) Prior Publication Data

US 2004/0217996 A1 Nov. 4, 2004

(51) Int. Cl.
*B41J 2/195* (2006.01)
*B41J 29/393* (2006.01)

(52) U.S. Cl. ..... 347/7; 347/19

(58) Field of Classification Search ..... 347/7
See application file for complete search history.

(56) References Cited

U.S. PATENT DOCUMENTS 2,714,715 A * 8/1955 Manier ..... 340/624
3,951,309 A * 4/1976 Kadowaki ..... 222/64
4,206,912 A * 6/1980 Pearson ..... 271/154
4,254,311 A * 3/1981 Sisk, Jr. ..... 200/61.07
4,337,632 A * 7/1982 Lienert ..... 72/53
4,720,798 A * 1/1988 Reed et al. ..... 716/19
5,061,832 A * 10/1991 Squires ..... 200/83 J
5,250,768 A * 10/1993 Van Fossen ..... 200/84 R
5,912,688 A * 6/1999 Gragg ..... 347/86
6,318,826 B1 * 11/2001 Froger et al. ..... 347/7
6,386,693 B1 * 5/2002 Michele et al. ..... 347/86
6,513,891 B2 * 2/2003 Eida ..... 347/7
6,848,762 B2 * 2/2005 King et al. ..... 347/7

* cited by examiner

*Primary Examiner*—Stephen Meier
*Assistant Examiner*—Shelby Fidler

(57) ABSTRACT

An out of ink signal mechanism for an inkjet printer having at least one inkbag is disclosed. The signal mechanism includes a printed circuit board having a circuit associated with each inkbag, a contact spring and at least one lifter. The contact spring is biased towards the printed circuit board so as to normally close the circuit. The lifter is arranged to contact the contact spring when the inkbag is out of ink so as to move the contact spring to open the circuit and thereby signal an out of ink condition of the printer head of the inkjet printer.

12 Claims, 5 Drawing Sheets

OUT OF INK SIGNAL MECHANISM FOR AN INKJET PRINTER

FIELD OF THE INVENTION

The invention relates to generally to inkjet printers and more specifically to an out of ink signal mechanism for an ink jet printer.

BACKGROUND OF THE INVENTION

To reduce the cost per page of printing, commercial grade inkjet printers are designed so that the print heads are not disposed of when the ink runs out. Instead, ink is supplied to the print heads by a pump mechanism from disposable inkbags.

One form of conventional pump mechanism includes a series of lifters (one per bag) that push against an associated diaphragm of a refill chamber in the disposable inkbag. A one-way valve divides the inkbag into a main reservoir and the refill chamber. The pressure of the lifter on the diaphragm causes the ink in the refill chamber to be pressurized and this forces ink to flow out to the associated pen via an ink tube. However, when the refill chamber is empty, no resistance is provided to the lifter by the ink and thus the lifter is free to move to a height that is known as the "out of ink height". When the lifter reaches the "out of ink height", a sensor is triggered by a component associated with the lifter. This in turn provides a signal to a user that the inkbag refill chamber is out of ink. Typically, the sensor is an optical sensor.

One of the requirements of the above arrangement is that there is a need to accurately signal when the refill chamber is empty. It has been found however that due to the various parts between the lifter and the component that actually triggers the sensor, there can be a lot of inherent error in the mechanism and thus the sensor may not be properly triggered. The errors may be due to manufacturing tolerances of the components, assembly errors and wear and tear over time. Additionally, optical sensors can have variations in their diode location, which in turn results in variations in the trigger point.

To overcome the above mentioned problems it has been necessary to adjust the "out of ink height" of the pump mechanism. This requires manual adjustment of the height of each lifter of the inkjet printer which is a time consuming and tedious procedure incurring extra expense and process time.

The present invention seeks to provide an improved mechanism for signalling that the refill chamber of the disposable inkbag in inkjet printer is empty.

SUMMARY OF THE INVENTION

According to the present invention there is provided an out of ink signal mechanism for an inkjet printer having at least one inkbag, said signal mechanism including a printed circuit board having a circuit associated with said at least one inkbag, a contact spring and at least one lifter, wherein said lifter is arranged to contact said contact spring when the inkbag is out of ink so as to move said contact spring to either open or close said circuit and thereby signal an out of ink condition of said inkjet printer.

BRIEF DESCRIPTION OF THE DRAWINGS

The invention will now be described in further detail by reference to the attached drawings illustrating example forms of the invention. It is to be understood that the particularity of the drawings does not supersede the generality of the preceding description of the invention. In the drawings.

DETAILED DESCRIPTION OF THE PREFERRED EMBODIMENTS

Figure 1:
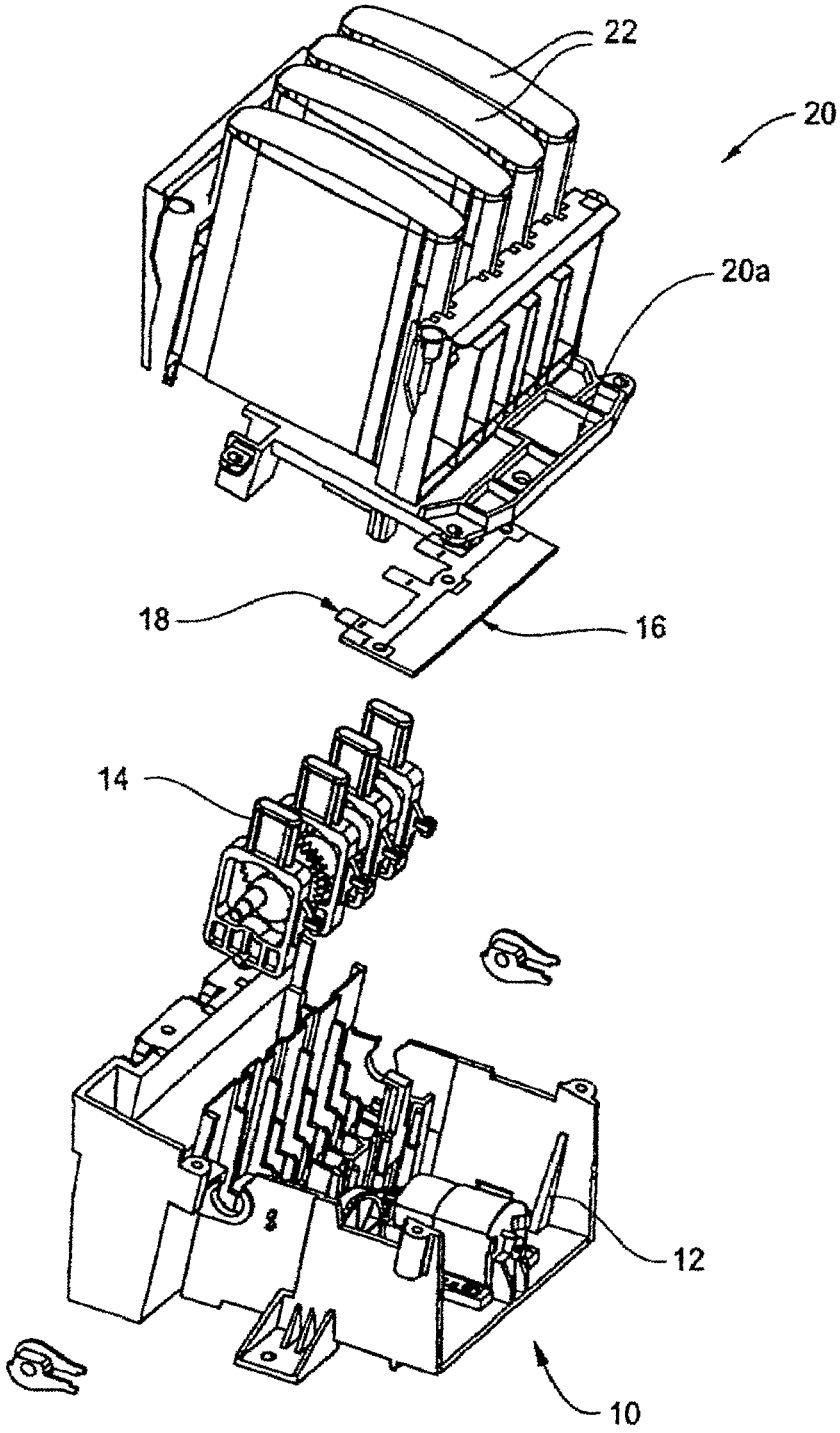
FIG. 1 is an assembly view of a pump mechanism for an inkjet printer incorporating an out of ink signal mechanism according to an embodiment of the present invention.

FIG. 1 illustrates a pump assembly 10 for an inkjet printer (not shown). The pump assembly 10 includes a pump mechanism 12, a set of four lifters 14, a printed circuit board (PCB) 16, a set of four contact springs 18 and an inkbag holder assembly 20. The assembled pump assembly 10 is arranged to be readily mounted within an inkjet printer.

The pump assembly 10 includes four print heads (not shown), with each print head receiving ink from an associated disposable inkbag 22. Each inkbag 22 is mounted within the inkbag holder assembly 20 so that it can be easily removed there from. Although the pump assembly 10 is described as having four print heads it will be appreciated that the use of a different number of print heads is anticipated.

Figure 2:
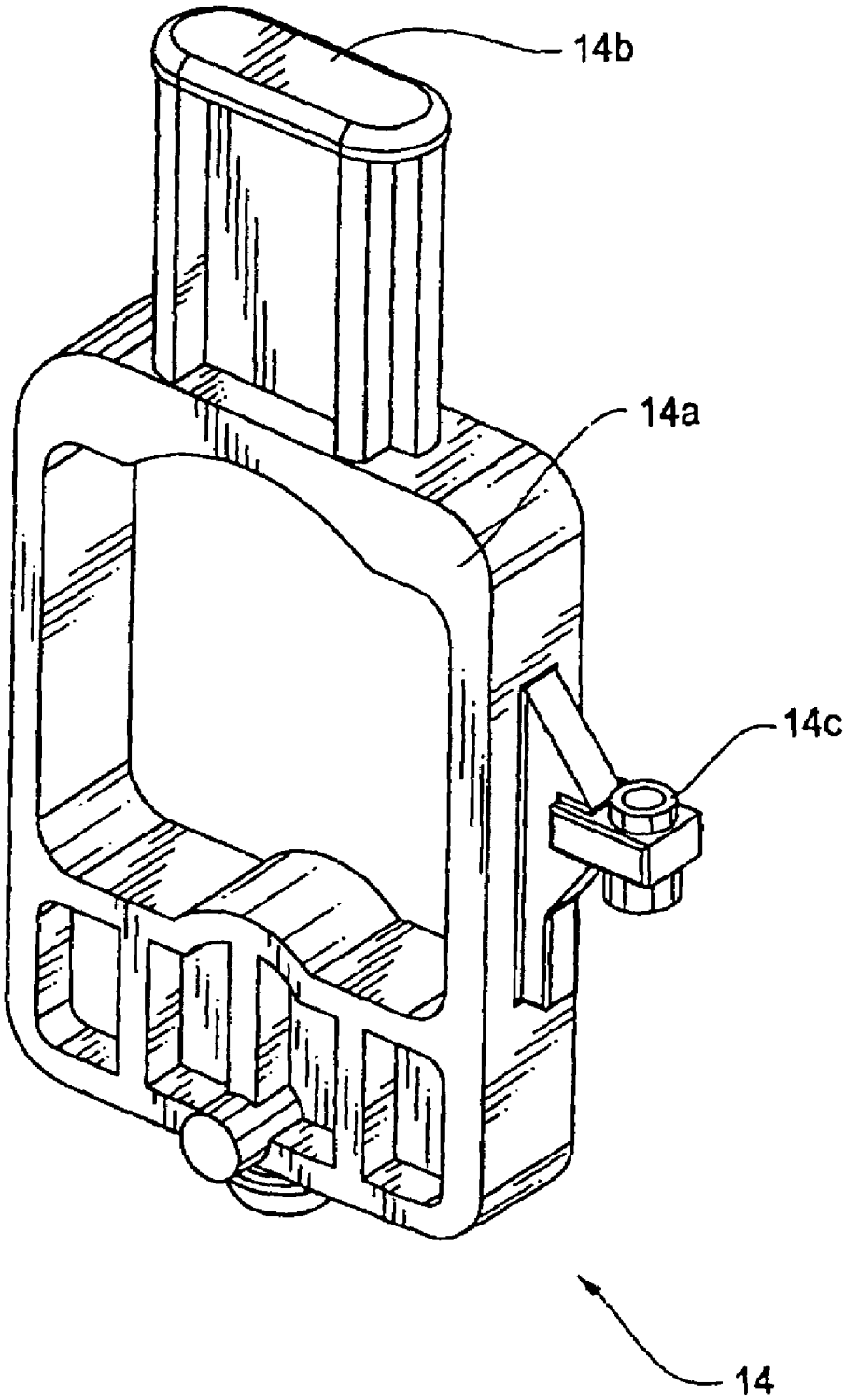
FIG. 2 is a perspective view of a lifter according to an embodiment of the invention.

FIG. 2 illustrates one of the lifters 14 in more detail. As shown in this Figure, the lifter 14 includes a main body 14*a*, a lifter finger 14*b* and a spring contact portion 14*c*. The lifter finger 14*b* extends from a top portion of the main body 14*a* and is arranged during use to press upwardly against the diaphragm of an associated ink bag 22. The pressure applied to the diaphragm by the lifter finger 14*b* serves to pressurise the ink in the refill chamber of the ink bag 22. This causes ink to flow to the associated ink pen (not shown) via an ink tube (not shown). The spring contact portion 14*c* extends from a side portion of the main body 14*a* of the lifter 14. The function of the spring contact portion 14*c* will be described below.

Figure 3:
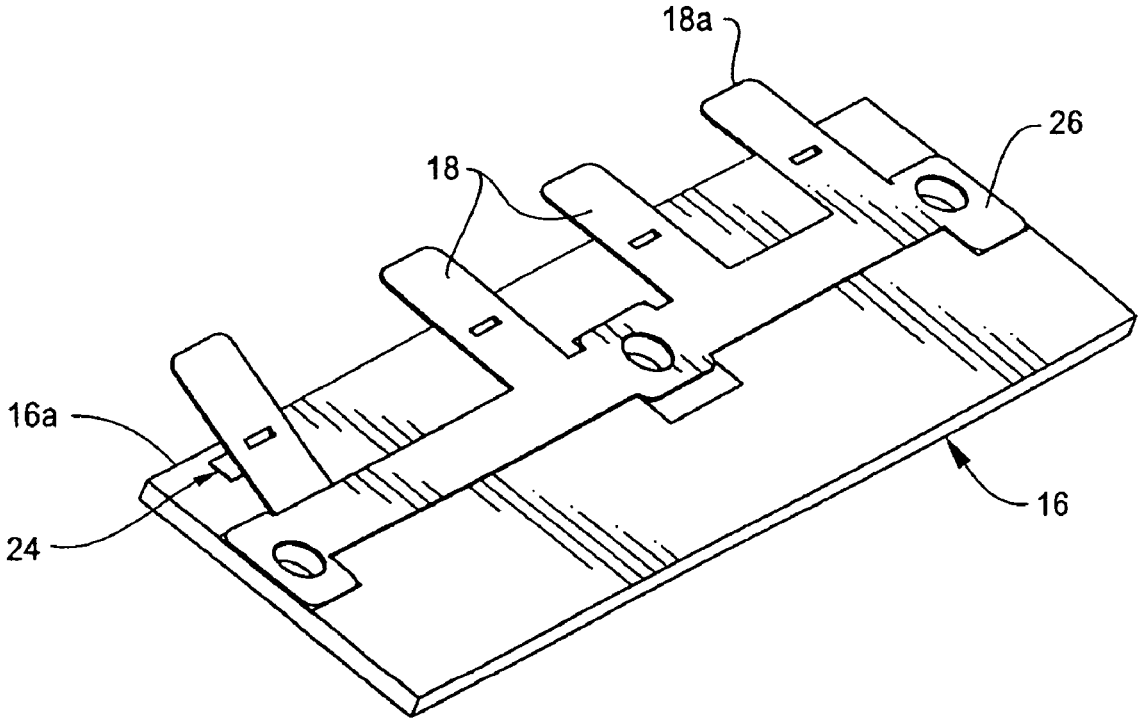
FIG. 3 is an enlarged view of the printed circuit board and contact spring of the out of ink signal mechanism shown in FIG. 1 in accordance with an embodiment of the invention.

FIG. 3 illustrates in more detail the construction of the four contact springs 18 of the pump assembly 10. As is shown in this Figure, each contact spring 18 is formed as a substantially flat elongated member that is cantilevered from a base plate 26. The contact springs 18 and base plate 26 are die cut from a single sheet of spring steel. The underside of each contact spring 18 adjacent its leading end 18*a* is formed with at least one bump or protrusion (not shown). As manufactured, each contact spring 18 extends substantially coplanar with the base plate 26. However, when the contact springs 18 and base plate 26 are sandwiched between the printed circuit board 16 and the floor 20*a* of the inkbag holder assembly 20, the at least one bump or protrusion of each spring 18 contacts the printed circuit board 16 and deflects the contact springs 18 from their manufactured state. This induces a bias in the contact springs 18 that normally holds the contact springs 18 in contact with their respective contact pad 24. The base plate 26 is secured to the printed circuit board 16 using a plurality of screws.

The leading end 18*a* of each contact spring 18 extends beyond an edge 16*a* of the printed circuit board 16 so that the associated lifter 14 is able to readily contact the contact spring 18 and cause movement thereof when the associated inkbag 22 is empty. This contact between the lifter 14 and an associated contact spring 18 will be described in more detail below.

When the refill chamber of each inkbag 22 contains ink, the downward pressure of that ink against the associated lifter 14 is sufficient to prevent any further upward movement of the lifter 14. However, when there is no or insufficient ink in the refill chamber, the lifter 14 is free to move upwardly. When this occurs, the "out of ink" signal is triggered. The manner in which the "out of ink" signal is triggered will be explained below.

Figure 4:
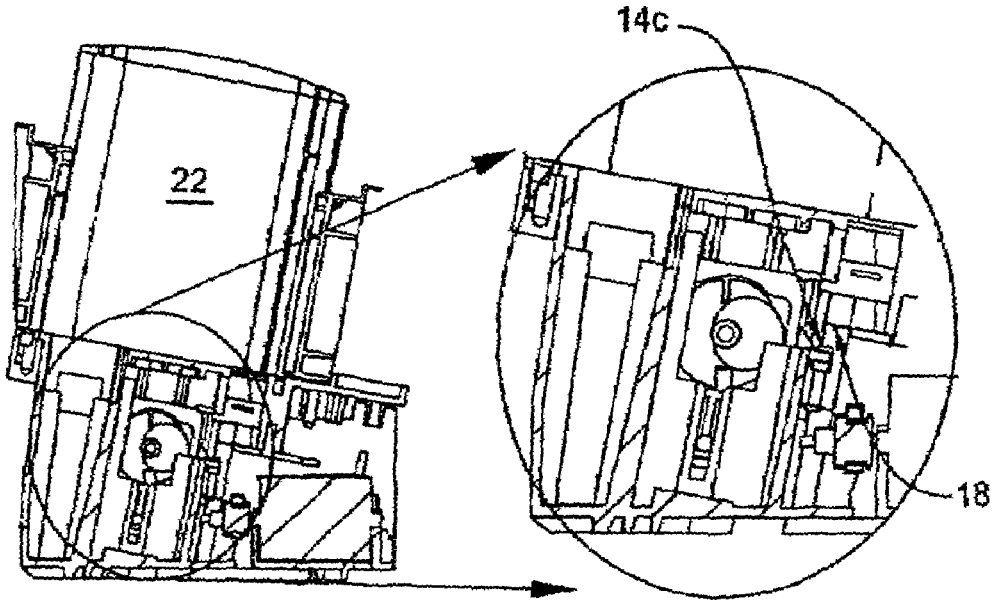
FIG. 4 illustrates a lifter of the out of ink signal mechanism prior to contact with the contact spring in accordance with an embodiment of the invention.
Figure 6:
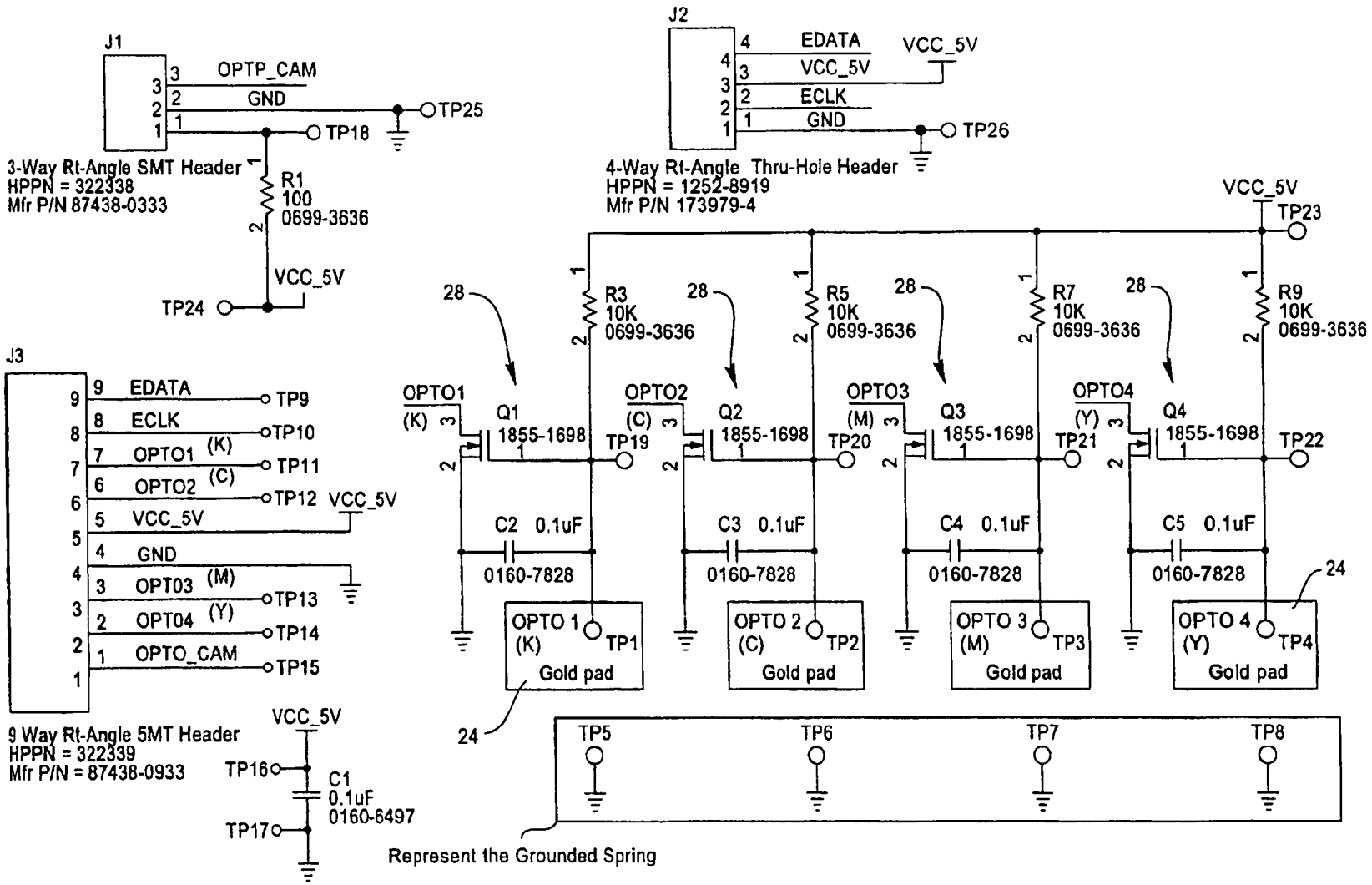
FIG. 6 is a layout of a printed circuit board according to an embodiment of the invention.

As shown in FIG. 6, the circuit board 16 includes a trigger circuit 28 for each of the inkbags 22 of the pump assembly 10. Each circuit 28 includes a contact pad 24 on the circuit board 16 which is arranged to be contacted by the associated contact spring 18. Each contact spring 18 is biased, as previously explained, to contact the contact pad 24 of its associated circuit 28 so that four closed circuits 28 are normally formed. This is the position that each contact spring 18 adopts when the associated inkbag 22 contains ink and the lifter 14 is in a position below an "out of ink height". Such a positioning of one of the lifters 14 is shown in FIG. 4.

Figure 5:
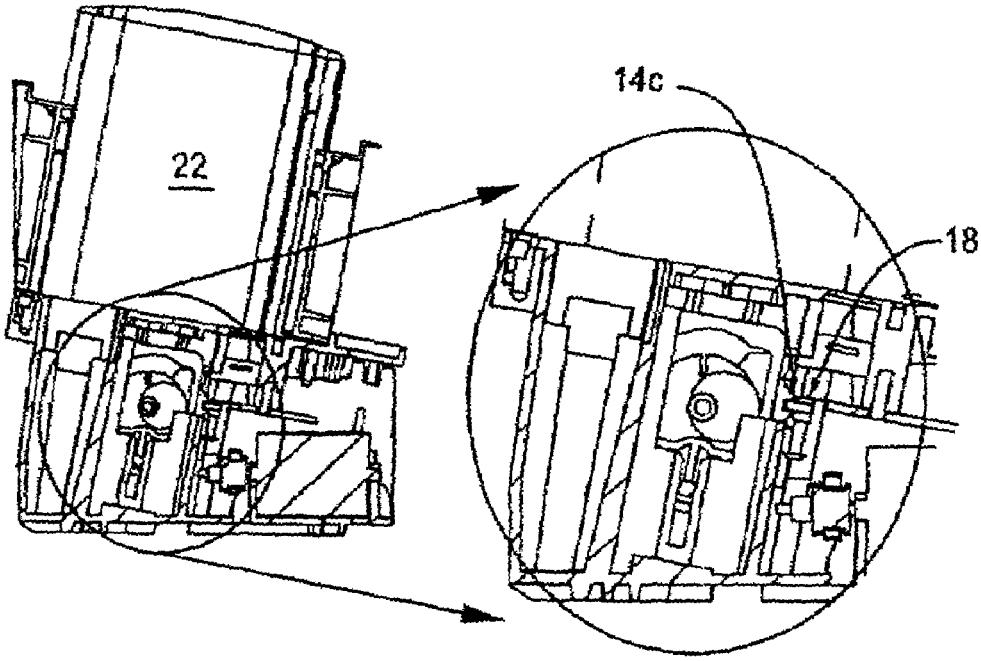
FIG. 5 illustrates the lifter shown in FIG. 3 in contact with the contact spring in accordance with an embodiment of the invention.

When any of the inkbag refill chambers becomes empty or contains insufficient ink, the associated lifter 14 will be free to move upwardly and the spring contact portion 14*c* of that lifter 14 will contact the associated contact spring 18 (as shown in FIG. 5). When this occurs, the contact spring 18 is caused to move away from the associated contact pad 24 thereby breaking the circuit 28 associated with that inkbag 22. When the circuit 28 is repeatedly broken in quick succession, a signal is triggered to alert a user to the fact that the inkbag 22 needs to be replaced. It will of course be appreciated that numerous mechanisms for signalling to a user the need to replace the inkbag 22 following triggering of the signal may be adopted.

The pump assembly 10 is advantageous because there is no need to adjust the "out of ink height" of the lifters 14. This is because there is a reduced number of parts as compared to prior art arrangements and thus the amount of inherent error is reduced. The reduction in the number of parts as compared to prior art arrangements also results in a reduction in part costs and assembly costs of the pump assembly. Accordingly, the present invention provides a substantially improved mechanism for signalling that the inkbag of an inkjet printer needs to be replaced.

The embodiment has been described by way of example only and modifications within the spirit and scope of the invention are envisaged.

The invention claimed is:

1. An out of ink signal mechanism for an inkjet printer having at least one inkbag, said signal mechanism comprising: a printed circuit board having a circuit associated with said at least one inkbag, said circuit comprising a contact pad formed on said printed circuit board; a contact spring; and at least one movable lifter, wherein, when said inkbag contains an amount of ink, said contact spring is in contact with said contact pad to form a closed circuit and said lifter is out of contact with said contact spring, and wherein, when said inkbag is out of ink, said lifter is movable into contact with said contact spring so as to break the contact between the contact spring and the contact pad and to open said circuit, thereby signalling an out of ink condition of said inkjet printer.

2. An out of ink signal mechanism for an inkjet printer having at least one inkbag, said signal mechanism comprising a printed circuit board having a circuit associated with said at least one inkbag, a contact spring and at least one lifter, said contact spring being biased towards said printed circuit board so as to normally close said circuit, wherein said lifter is arranged to be out of contact with said contact spring when the inkbag contains an amount of ink and to move into contact with said contact spring when the inkbag is out of ink so as to move said contact spring to open said circuit, thereby signalling an out of ink condition of said inkjet printer.

3. An out of ink signal mechanism for an inkjet printer according to claim 2 wherein the inkjet printer comprises a plurality of inkbags, and the printed circuit board comprises a circuit for each of the inkbags of the inkjet printer to which the signal mechanism is to be fitted, an associated lifter and an associated contact spring.

4. An out of ink signal mechanism for an inkjet printer according to claim 3 wherein said out of ink condition of said inkjet printer is signalled when any of the circuits of the printed circuit board is opened.

5. An out of ink signal mechanism for an inkjet printer according to claim 3 further comprising a contact pad in each circuit, said contact pad being formed on the printed circuit board so that the associated contact spring can contact the contact pad to close the associated circuit.

6. An out of ink signal mechanism for an inkjet printer according to claim 4 further comprising identifying means to identify to a user which of the inkbags is out of ink and thus needs replacing.

7. An out of ink signal mechanism for an inkjet printer according to claim 3 wherein each contact spring comprises a substantially flat member which is cantilevered from a base plate.

8. An out of ink signal mechanism according to claim 7 wherein the contact springs and base plate are die cut from a single sheet of spring steel.

9. An out of ink signal mechanism according to claim 7 wherein at least one protrusion is formed on the underside of each contact spring.

10. An out of ink signal mechanism for an inkjet printer according to claim 7 wherein the base plate is arranged to be mounted on the printed circuit board so that the contact spring is located between the printed circuit board and a floor of an inkbag holder assembly.

11. An out of ink signal mechanism for an inkjet printer according to claim 7 wherein each contact spring is elongated and has a leading end that extends beyond an edge of the printed circuit board so that it can be contacted by its associated lifter.

12. A pump assembly for an inkjet printer having at least one inkbag, said pump assembly comprising a pump mechanism and an out of ink signal mechanism, said signal mechanism comprising a printed circuit board having a circuit associated with said at least one inkbag, a contact spring and at least one lifter, said contact spring being biased towards said printed circuit board so as to normally close said circuit, wherein said lifter is arranged to be out of contact with said contact spring when the inkbag contains an amount of ink and to move into contact with said contact spring when the inkbag is out of ink so as to move said contact spring to open said circuit, thereby signalling an out of ink condition of said inkjet printer.

* * * * *